US005647769A

United States Patent [19]

Takeuchi

[11] Patent Number: 5,647,769

[45] Date of Patent: Jul. 15, 1997

[54] ELECTRICAL CONNECTION BOX

[75] Inventor: Kinihiko Takeuchi, Shizuoka-ken, Japan

[73] Assignee: Yazaki Corporation, Tokyo, Japan

[21] Appl. No.: 590,882

[22] Filed: Jan. 24, 1996

[30] Foreign Application Priority Data

Jan. 25, 1995 [JP] Japan ..... 7-009885

[51] Int. Cl.[6] ..... H01R 13/68

[52] U.S. Cl. ..... 439/621; 439/701

[58] Field of Search ..... 439/621, 488, 439/489, 752, 595, 622, 949, 686, 695, 701, 76.2

[56] References Cited

U.S. PATENT DOCUMENTS

| | | | |
|---|---|---|---|
| 5,328,382 | 7/1994 | Pawlicki | 439/595 |
| 5,445,541 | 8/1995 | May et al. | 439/595 |
| 5,522,740 | 6/1996 | Plocek et al. | 439/595 |

FOREIGN PATENT DOCUMENTS

| | | |
|---|---|---|
| 58-23189 | 2/1983 | Japan . |
| 95-1451 | 2/1995 | Japan . |

OTHER PUBLICATIONS

Japan Institute of Invention and Innovation Technical Disclosure; Abstract, Fusible Link Block; Feb. 1, 1995.

*Primary Examiner*—Gary F. Paumen

*Attorney, Agent, or Firm*—Finnegan, Henderson, Farabow, Garrett & Dunner, L.L.P.

[57] ABSTRACT

A main cover has a fitting cylinder portion having one-side opening as a fitting port for fitting an opposite part. The fitting cylinder portion has a lock portion formed therein. An under cover has a fitting wall which is fitted in the fitting cylinder portion from the other side opening of the main cover and a fitting recessed portion having an opened end portion and formed on the internal side of the fitting wall. The fitting wall has, when the fitting wall is to be fitted in the fitting cylinder portion, a flexible lock arm which is deflected and deformed inwardly in the fitting recessed portion in the middle of the fitting operation and returns to an original shape to be engaged with the lock portion upon the fitting operation. The fitting recessed portion has, in a bottom portion thereof, a terminal connected to a terminal of the opposite part. A bus-bar distributing board arranged on the other side of the fitting cylinder portion of the main cover has a terminal connected to the terminal of the opposite part and an opening through which the fitting wall passes.

12 Claims, 4 Drawing Sheets

ELECTRICAL CONNECTION BOX

BACKGROUND OF THE INVENTION

1. Field of the Invention

The present invention relates to an electrical connection box such as a fusible link block and, more particularly, to an electrical connection box having a simple structure and being capable of reducing costs.

2. Prior Art

As a conventional fusible link block, a fusible link block is disclosed in a publication "Japan Institute of Invention and Innovation Technical Disclosure" (issued Feb. 1, 1995; technical disclosure number 95-1451). The fusible link block described in FIG. 1 of this publication is constituted by a main cover, a bus-bar distributing board, and an under cover, and is designed to insert a fusible link thereinto.

In the main cover, a cavity in which an fusible link insertion portion is fitted is arranged on the upper surface side, and a bus-bar terminal fitting portion and an under cover fitting portion are arranged on the lower surface side through the bottom wall of the cavity. Male/female terminals are stored in the bus-bar terminal fitting portion and the under cover fitting portion, respectively. The male terminal portion of each male/female terminal passes through the bottom wall of the cavity to extend into the cavity, and the female portion is arranged in the bus-bar terminal fitting portion and the under cover fitting portion to face downward.

A bus-bar distributing board is attached to the opening surfaces of the bus-bar terminal fitting portion and the under cover fitting portion, and has a male terminal piece integrated with a bus bar (not shown), and has an insertion hole through which the upper end portion of an under cover passes and an insertion hole through which the upper end of a male terminal stored in the under cover.

When this fusible link block is used, the bus-bar distributing board is attached to the lower surface of the main cover, and the male terminal piece arranged on the bus-bar distributing board is fitted in the female terminal portion of the male/female terminal. The under cover is attached to the main cover from the lower surface side of the bus-bar distributing board, the upper end of the male terminal set in the under cover is fitted, through the insertion hole of the bus-bar distributing board, in the female terminal portion of the male/female terminal set in the main cover. In this manner, the fusible link block to which the fusible link is to be attached is completed.

In this state, the insertion portion of the fusible link is fitted in the cavity of the main cover to fit the female terminal in the fusible link and the male terminal portion of the male/female terminal in the main cover, thereby electrically inserting the fusible link between a bus-bar circuit and a circuit connected to the male terminal of the under cover.

Since the fusible link block described above uses male/female terminals to connect terminals to each other, costs tend to increase, and electrical connection performance may be degraded due to a large number of contact connection portions.

Therefore, in order to solve the above problem, a fusible link block described in the above publication with reference to FIGS. 2 and 3 is proposed.

This block is constituted by a main cover (first housing), a bus-bar distributing board, and an under cover (second housing). A male/female terminal is omitted in the main cover.

The main cover has a fitting cylinder portion having an upper surface side opening (one-direction opening) as a fitting port of the fusible link. The inside of the fitting cylinder portion is used as a cavity for fitting the fusible link, and a stopper for determining the insertion limit of the under cover is arranged at the upper end of the fitting cylinder portion. A lock portion corresponding to the under cover is formed on the outer peripheral wall of the main cover.

One side of a lower surface side opening of the fitting cylinder portion is kept open, the remaining side is closed by a bus-bar distributing board attachment portion. A bus-bar distributing board is attached to the lower surface of the bus-bar distributing board attachment portion.

The bus-bar distributing board has a male terminal integrated with a bus-bar, and the male terminal extends into the cavity. An opening is formed in the bus-bar distributing board.

The under cover has a bottom wall and an outer peripheral wall, and a lock arm which is to be locked in the lock portion in the main cover is formed on the outer peripheral wall. A columnar projecting portion extends from the upper surface of the bottom wall, and a fitting wall which passes through the opening of the bus-bar distributing board and is fitted into the cavity of the main cover is connected to the upper end of the columnar projecting portion. A fitting recessed portion for fitting an insertion portion of the fusible link is formed inside of the fitting wall. A guide wall having a height and a thickness which are adjusted to relatively small values constitutes one side of the fitting wall, and the guide wall is designed to be fitted in a central guide groove when the fusible link is inserted in the fusible link block.

A terminal insertion hole is arranged inside the columnar projecting portion, and a male terminal inserted into the terminal insertion hole from the lower direction is engaged by a lance, and the upper end portion of the male terminal extends into the fitting recessed portion.

When this fusible link block is used, the bus-bar distributing board is arranged inside the main cover, and the male terminal is extended into the cavity of the fitting cylinder portion. The under cover is attached to the main cover from the lower surface side of the bus-bar distributing board, and the fitting wall at the end of the columnar projecting portion of the under cover is fitted in the cavity of the main cover through the opening of the bus-bar distributing board.

In this manner, the male terminal arranged on the bus-bar distributing board and the male terminal of the under cover are arranged parallel to each other in the cavity, and the fitting cylinder portion and these terminals constitute a connector portion for attaching the fusible link. Thereafter, the fusible link is inserted into the connector portion to complete electrical connection of the fusible link.

According to this fusible link block, although the main cover and the under cover are used, the male terminal stored in the under cover is directly connected to the terminal of the fusible link. For this reason, the main cover requires no male/female terminal (intermediate connection terminal) arranged thereon, a simple structure can be obtained, and electrical connection performance.

Since terminals are partially constituted by the bus-bar distributing board, circuits such as a ground line which can be arranged common can be integrated at a high density, a simple structure can be obtained, and a reduction in cost can be performed. In particular, since the connector terminal is constituted by the male terminal stored in the under cover and the male terminal arranged on the bus-bar distributing board, like a general connector, the connector terminal can be advantageously connected to an opposite part without excessive wires.

However, in this fusible link block, since the lock portion and the lock arm are arranged at positions which are far from the fitting portion of the fusible link, the under cover is deflected downward when the fusible link is fitted. For this reason, a fitting operation of the fusible link may not be smoothly performed. In addition, a spare space is required to arrange the lock portion and the lock arm. When the lock portion is not properly fitted on the lock arm, the main cover is disconnected from the under cover. For this reason, a cumbersome checking operation must be performed.

In addition to the electrical connection box, utility model application laid open No. 58-23189 discloses a structure in which, a lock portion which is engaged with a lock portion formed in the end portion of a box is arranged on the outer surface of a connector for a fusible link when the connector is attached to the box.

However, in the structure described in this publication, the connector is attached to the lock portion formed on the end portion of the box, a coupling strength is disadvantageously low.

SUMMARY OF THE INVENTION

The present invention has been made in consideration of the above circumstances, and has as its object to provide an electrical connection box, constituted by combining a plurality of housings, which can increase the coupling strength between the housings, can be smoothly, simply, and reliably fitted to an opposite part, can save a space, and can be easily detect an incomplete fitting state between the housings.

In order to achieve the above object, the present invention provides an electrical connection box comprising: a first housing having a fitting cylinder portion having one-side opening as a fitting port for fitting an opposite part, the fitting cylinder portion having a lock portion formed therein; and a second housing having a fitting wall which is fitted in the fitting cylinder portion from the other side opening of the first housing and a fitting recessed portion having an opened end portion and formed on the internal side of the fitting wall; the fitting wall having, when the fitting wall is to be fitted in the fitting cylinder portion, a flexible lock arm which is deflected and deformed inwardly in the fitting recessed portion in the middle of the fitting operation and returns to an original shape to be engaged with the lock portion upon the fitting operation, and the fitting recessed portion having, in a bottom portion thereof, a terminal connected to a terminal of the opposite part, wherein a fitting projecting portion of the opposite part is fitted in the fitting recessed portion in a state that the fitting wall is fitted in the fitting cylinder portion.

In this manner, according to the present invention, when the fitting wall of the second housing is fitted in the fitting cylinder portion of the first housing, the flexible lock arm arranged on the fitting wall is engaged with the fitting cylinder portion so as to couple the first housing to the second housing. The fitting recessed portion of the second housing faces outside from one-side opening of the fitting cylinder portion of the first housing. The fitting wall is properly fit in the fitting cylinder portion, the flexible lock arm returns to an original position.

In this state, when the fitting projecting portion of the opposite part is fitted in the fitting recessed portion of the second housing, the terminal of the opposite part is connected to the terminal stored in the second housing. In this fitting operation, the fitting wall around the fitting recessed portion is directly locked in the fitting cylinder portion by the flexible lock arm, and a pressing pressure generated during the fitting operation is received by the lock portion which is extremely close to the fitting portion. For this reason, the second housing is not undesirably deflected, and the fitting operation can be smoothly performed.

When the fitting wall of the second housing and the fitting cylinder portion of the first housing are not set in a proper fitting state, i.e., when a fitting failure occurs, the flexible arm does not return to the original position, and is kept deflected and deformed in the flexible recessed portion. For this reason, the opposite part cannot be fitted in the fitting recessed portion because of the presence of the flexible lock arm. Therefore, it is understood that the first and second housings are set in an incomplete attachment state (semi-fitting state).

As described above, according to the present invention, since the flexible lock arm is directly arranged on the fitting wall, the coupling strength of the fitting portion can be increased, the opposite part can be smoothly fitted in the fitting recessed portion without being influenced by undesirable deflection. In addition, since the lock arm is arranged on the fitting wall, a lock arm need not be arranged on another portion, and a space for the lock arm can be omitted. When the first and second housings are set in an incomplete attachment state, the incomplete attachment state can be detected by checking whether the opposite part can be fitted, and the incomplete attachment state can be easily checked. Furthermore, since the deflection of the lock arm is prevented by the opposite part, an undesirable lock release can be prevented during the fitting operation.

Although the second housing is attached to the first housing, since the terminal stored in the second housing is directly connected to the terminal of the opposite part, an intermediate connection terminal (e.g., a male/female terminal having a male terminal portion and a female terminal portion arranged on both the ends of the male/female terminal) need not be arranged on the first housing side. For this reason, a simple structure can be obtained, and electrical connection performance can be advantageously improved.

In a preferred embodiment of the present invention, there is provide an electrical connection box further comprising: a bus-bar distributing board arranged on the other side of the fitting cylinder portion, the bus-bar distributing board having a terminal connected to the terminal of the opposite part and an opening through which the fitting wall passes.

According to this aspect of the present invention, the bus-bar distributing board is arranged on the other side of the fitting cylinder portion of the first housing, the fitting wall of the second housing is fitted in the fitting cylinder portion of the first housing through the opening of the bus-bar distributing board. In this case, the terminal on the bus-bar distributing board and the terminal arranged on the bottom portion of the fitting recessed portion are arranged parallel to each other in the fitting cylinder portion of the first housing, and the fitting cylinder portion and these terminals constitute a connector for coupling the opposite part.

Therefore, according to this aspect, since the terminals are partially constituted by the bus-bar distributing board, circuits such as a ground line which can be arranged common can be integrated at a high density, a simple structure can be obtained, and a reduction in cost can be performed. In addition, the opening is formed in the bus-bar distributing board, and the fitting wall of the second housing is inserted into the fitting cylinder portion of the first housing through the opening, so that the connector terminal is constituted by the terminal stored in the second housing and the terminal arranged on the bus-bar distributing board. Therefore, like a general connector, the connector terminal can be connected to an opposite part without excessive wires.

In the preferred aspect of the present invention, the flexible lock arm is formed as a portion between two slits formed in the fitting wall from an upper end of the fitting wall.

According to this aspect, the flexible lock can be formed within the width of the fixing wall, any spare space is not required to arrange the lock portion.

In the preferred aspect of the present invention, an engagement projection engaged with the lock portion is formed to extend from an outer surface of an upper end of the flexible lock arm.

In the preferred aspect of the present invention, an inclined surface and an engagement wall engaged with an upward engagement wall constituting the lock portion are formed in the upper and lower ends of the engagement projection, respectively.

The nature, principle and utility of the invention will become more apparent from the following detailed description when read in conjunction with the accompanying drawings.

DESCRIPTION OF THE PREFERRED EMBODIMENT

An embodiment of the present invention will be described below with reference to the accompanying drawings.

Figure 1:
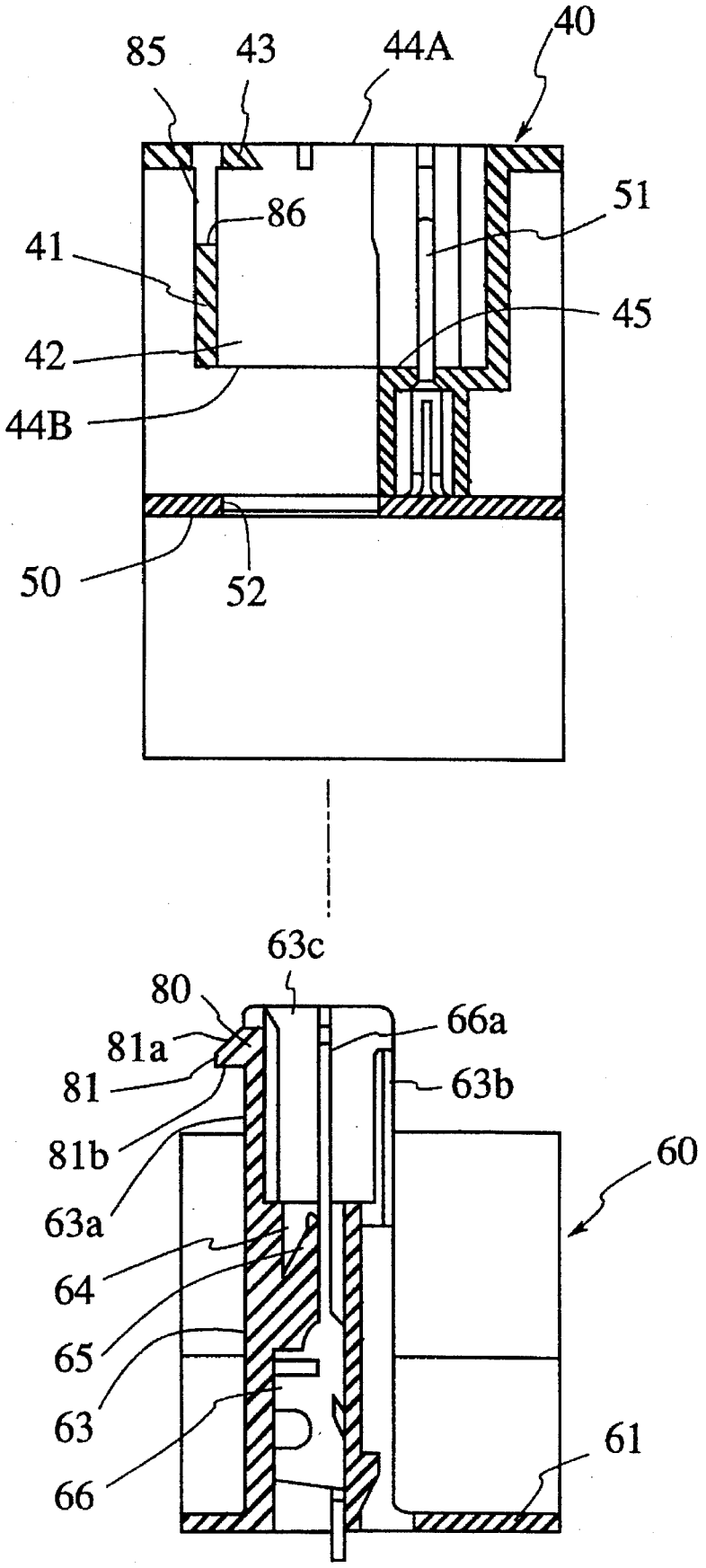
FIG. 1 is a sectional side view showing a fusible link block, before assembling, serving as an embodiment of an electrical connection box according to the present invention.
Figure 2:
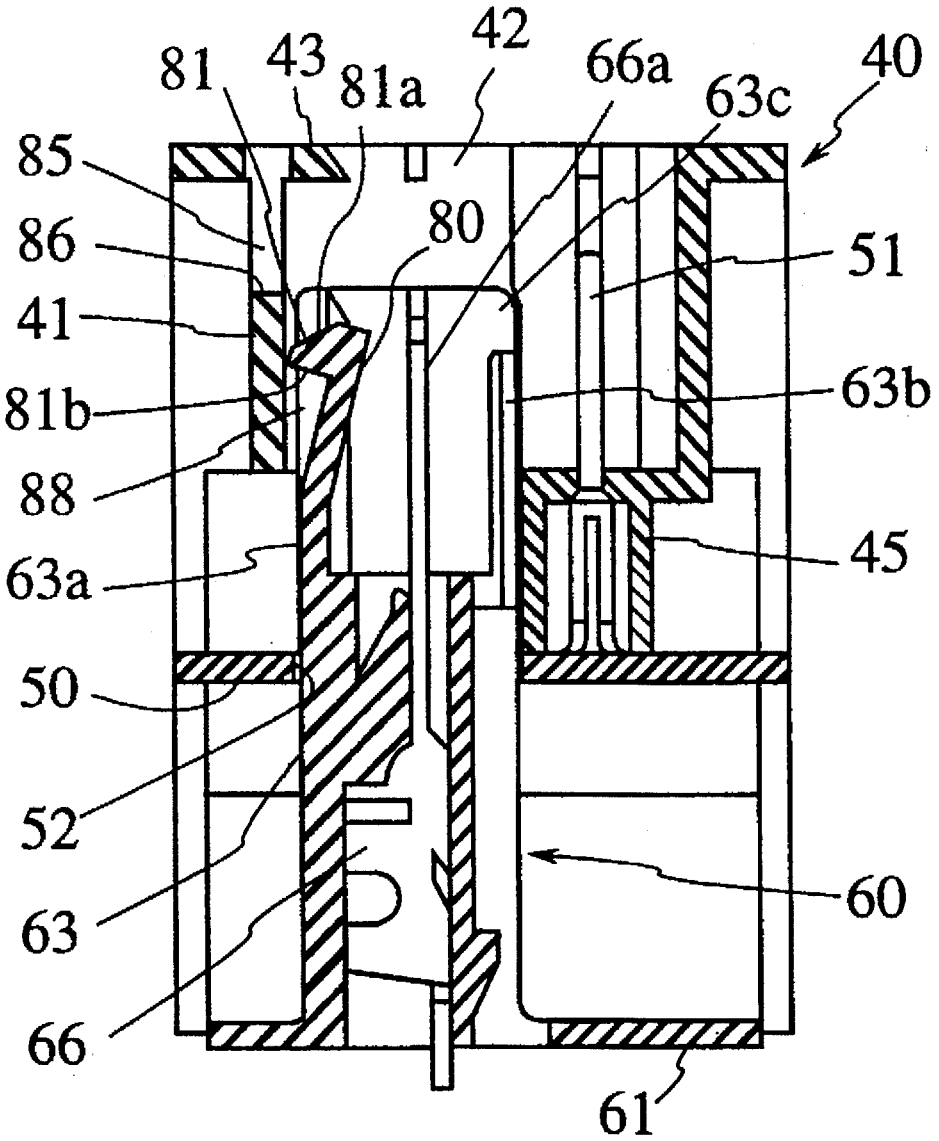
FIG. 2 is a sectional side view showing the fusible link block in the middle of assembling.
Figure 3:
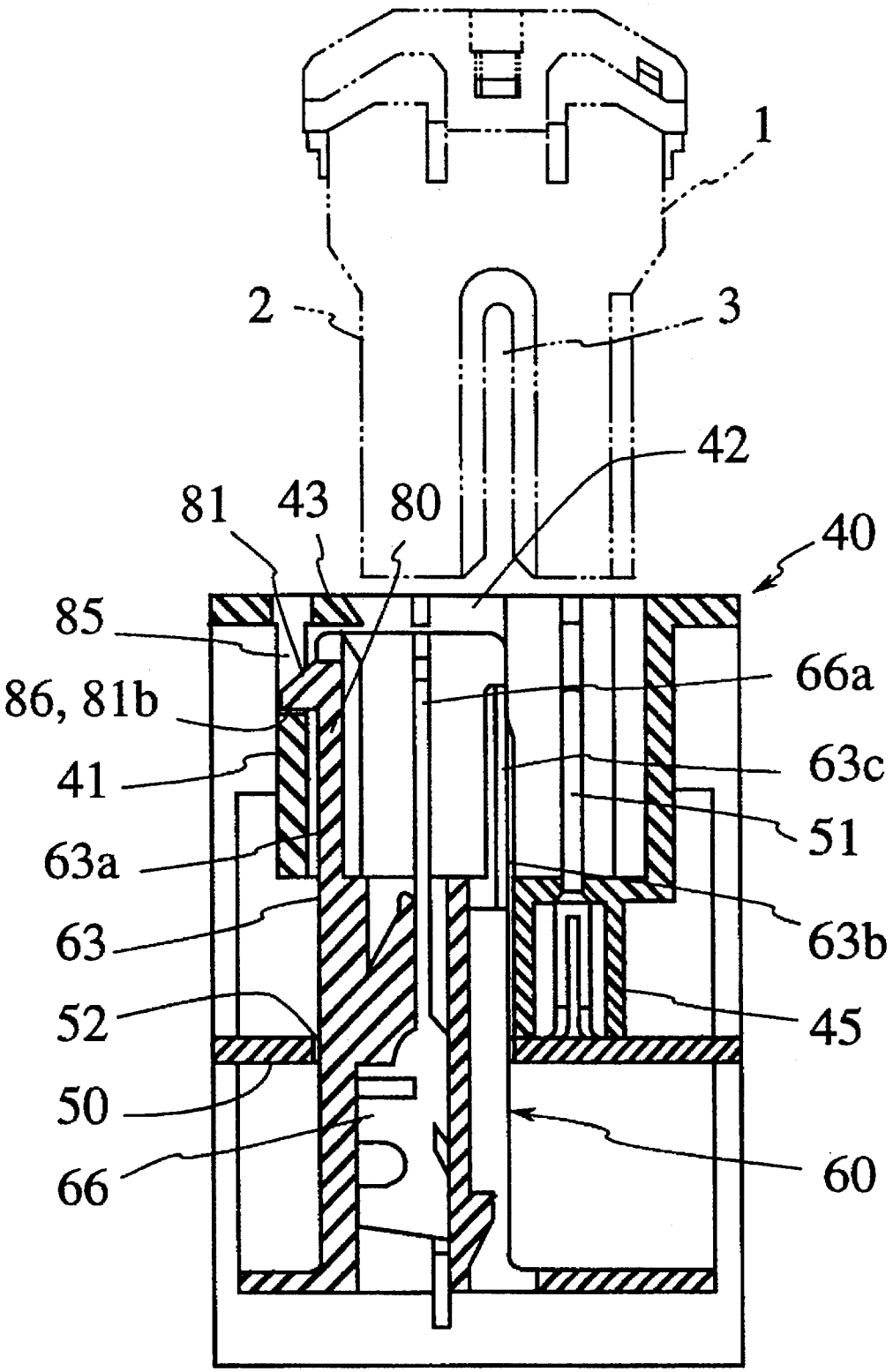
FIG. 3 is a sectional side view showing the fusible link block upon assembling.
Figure 4:
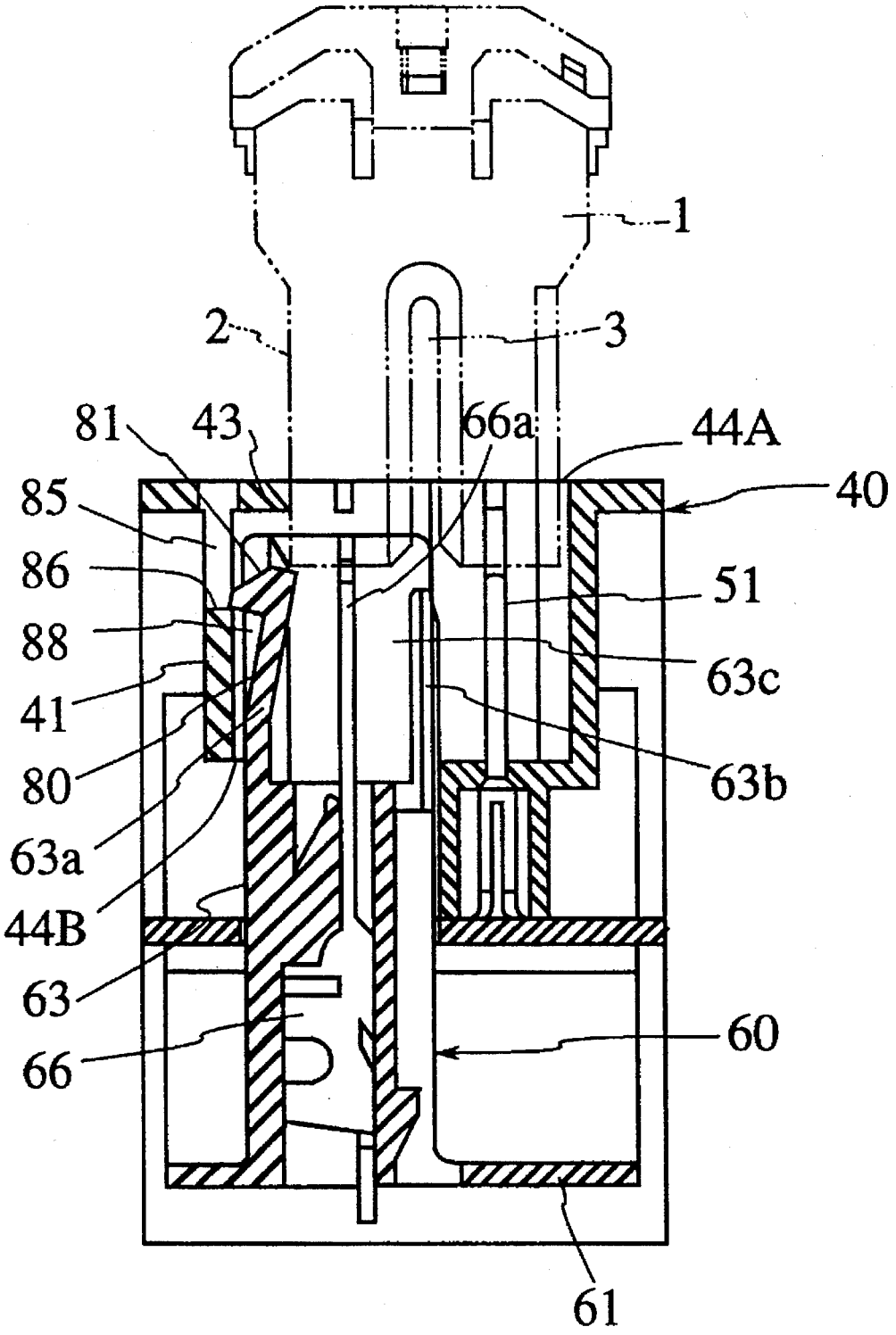
FIG. 4 is a sectional side view showing a state wherein a fusible link is to be inserted in a fusible link block which is defectively assembled.

FIG. 1 is a sectional side view showing a fusible link block, before assembling, according to this embodiment; FIG. 2 is a sectional side view showing the fusible link block in the middle of assembling; FIG. 3 is a sectional side view showing the fusible link block upon assembling; and FIG. 4 is a sectional side view showing a state wherein a fusible link is to be inserted in a fusible link block which is defectively assembled.

This fusible link block is constituted by a main cover (first housing) 40, a bus-bar distributing board 50, an under cover (second housing) 60. A male/female terminal is omitted in the main cover 40.

The main cover 40 has a fitting cylinder portion 41 having an upper surface side opening (one-direction opening) as a fitting port of the fusible link. The inside of the fitting cylinder portion 41 is used as a cavity 42 for fitting the fusible link, and a stopper 43 for determining the insertion limit of the under cover 60 is arranged at the upper end of the fitting cylinder portion 41.

One side of the lower surface side opening 44 of the fitting cylinder portion 41 is kept open, the remaining side is closed by a bus-bar distributing board attachment portion 45. A bus-bar distributing board 50 is attached to the lower surface of the bus-bar distributing board attachment portion 45.

The bus-bar distributing board 50 has a male terminal 51 integrated with a bus-bar, and the male terminal 51 extends into the cavity 42. An opening 52 is formed in the bus-bar distributing board 50.

The under cover 60 has a bottom wall 61. A columnar projecting portion 63 extends from the upper surface of the bottom wall 61, and a fitting wall **63*a* which passes through the opening 52 of the bus-bar distributing board 50 and is fitted into the cavity 42 of the main cover 40 is connected to the upper end of the columnar projecting portion. A fitting recessed portion 63*c* for fitting an insertion portion 2 of the fusible link is formed inside of the fitting wall 63*a*. A guide wall 63*b* having a height and a thickness which are adjusted to relatively small values constitutes one side of the fitting wall 63*a*, and the guide wall 63*b* is designed to be fitted in a central guide groove 3 when a fusible link 1** is inserted in the fusible link block.

A terminal insertion hole 64 is arranged inside the columnar projecting portion 63, and a male terminal 66 inserted into the terminal insertion hole 64 from the lower direction is engaged by a lance 65, and the end portion **66*a* of the male terminal 66 extends into the fitting recessed portion 63*c***.

In particular, in the fusible link block of the embodiment of the present invention, the lock portion on the main cover 40 side and the lock arm on the under cover 60 side are arranged on the fitting cylinder portion 41 of the main cover 40 constituting the fitting portion of the fusible link 1 and on the fitting wall **63*a* of the under cover 60**, respectively.

More specifically, in the fusible link block of this embodiment, a lock hole (lock portion) 85 is formed in the upper end of the fitting cylinder portion 41 of the main cover 40, and a flexible lock arm 80 is arranged on the fitting wall **63*a* of the under cover 60 corresponding to the lock hole 85**.

The flexible lock arm 80 used in this case is formed as a portion between two slits 88 formed in the fitting wall **63*a* from its upper end. When the fitting wall 63*a* is fitted in the fitting cylinder portion 41, the flexible lock arm 80 is deflected and deformed into the fitting recessed portion 63*c* in the middle of the fitting operation. When the fitting wall 63*a* is properly fitted in the fitting cylinder portion 41, the flexible lock arm 80 returns to the original state to be engaged with the lock portion 85 of the fitting cylinder portion 41**.

An engagement projection 81 to be engaged with the lock hole 85 extends from the outer surface of the upper end of the flexible lock arm 80. An inclined surface **81*a* and an engagement wall 81*b* engaged with an upward engagement wall 86 on the lock hole 85 side are formed on the upper and lower ends of the engagement projection 81**, respectively.

An operation will be described below.

As shown in FIGS. 2 and 3, when the fitting wall **63*a* of the under cover 60 is fitted in the cavity 42 in the fitting cylinder portion 41 of the main cover 40 through the opening 52 of the bus-bar distributing board 50, the flexible lock arm 80 arranged on the fitting wall 63*a* is deflected and deformed into the fitting recessed portion 63*c* to be engaged with lock hole 85 arranged in the fitting cylinder portion 41, thereby coupling the main cover 40 to the under cover 60. The fitting recessed portion 63*c* of the under cover 60 faces outside from an upper surface side opening 44A of the fitting cylinder portion 41 of the main cover 40. At this time, when the fitting wall 63*a* is properly fitted in the fitting cylinder portion 41, the flexible lock arm 80 returns to the original position (within the fitting wall 63*a***).

In this state, when the insertion portion 2 of the fusible link 1 is fitted in the fitting recessed portion 63*c* of the under cover 60, the terminal of the fusible link 1 is connected to the male terminal 66 stored in the under cover 60 and to the male terminal 51 of the bus-bar distributing board 50. At this time, since the fitting recessed portion 63*c* is directly locked in the fitting wall 63*a*, there is no danger of the under cover 60 being forcibly deflected, and the fitting operation can be smoothly performed.

As shown in FIG. 4, when the fitting wall 63*a* of the under cover 60 and the fitting cylinder portion 41 of the main cover 40 are not set in a proper fitting state, i.e., when a fitting failure occurs, the flexible arm 80 does not return to an original position, and is kept deflected and deformed in the flexible recessed portion 63*c*. For this reason, the fusible link 1 cannot be smoothly fitted in the fitting recessed portion 63*c* because of the presence of the flexible lock arm 80. Therefore, it is understood that the main cover 40 and the under cover 60 are set in an incomplete attachment state (semi-fitting state).

In addition, since the lock arm 80 is arranged within the fitting wall 63*a*, a space is not required for a lock mechanism. For this reason, this arrangement can contributes to saving of the whole space.

Note that the effect described above is not lost.

More specifically, although the main cover 40 and the under cover 60 are used, since the male terminal 66 stored in the under cover 60 is directly connected to the terminal on the fusible link 1 side, a male/female terminal (intermediate connection terminal) need not be arranged on the main cover 40 side. For this reason, a simple structure can be obtained, and electrical connection performance can be improved.

Since terminals are partially constituted by the bus-bar distributing board 50, circuits such as a ground line which can be arranged common can be integrated at a high density, a simple structure can be obtained, and a reduction in cost can be performed. In particular, since the connector terminal is constituted by the male terminal 66 stored in the under cover 60 and the male terminal 51 arranged on the bus-bar distributing board 50, like a general connector, the connector terminal can be connected to an opposite part without excessive wires.

Since the above embodiment describes the structure of a portion to which the fusible link 1 is attached, two terminals are arranged. However, when an opposite part is a relay or the like, the number of terminals can be changed depending on the opposite part.

It should be understood that many modifications and adaptations of the invention will become apparent to those skilled in the art and it is intended to encompass such obvious modifications and changes in the scope of the claims appended hereto.

What is claimed is:

1. An electrical connector comprising:

a first housing having a cylindrical portion formed with a first end opening to allow for passage of a mating connector into the cylindrical portion, said cylindrical portion having a lock portion formed therein; a second housing having a fitting wall capable of being fit in said cylindrical portion via a second opening formed in the cylindrical portion, an Inner surface of the fitting wall forming a recessed portion having an open end, the fitting wall having a flexible locking arm capable of being deflected and deformed in said recessed portion when the fitting wall is moved into the cylindrical portion, the locking arm returning to an original shape and being engaged with said lock portion when the fitting wall is fit in the cylindrical portion; and a terminal extending in the recessed position so that the terminal can be connected to a terminal of the mating connector, wherein a projecting portion of the mating connector is fit in said recessed portion when said fitting wall is fit in said cylinder portion.

2. An electrical connector according to claim 1, further comprising a bus-bar distributing board arranged on said cylindrical portion, said bus-bar distributing board having a terminal for connection with another terminal of the mating connector, the bus-bar distributing board having an opening through which said fitting wall passes.

3. An electrical connector according to claim 1, wherein said flexible lock arm is formed between two slits formed in said fitting wall, the two slits extending from an upper end of said fitting wall.

4. An electrical connector according to claim 2, wherein said flexible lock arm is formed between two slits formed in said fitting wall, the two slits extending from an upper end of said fitting wall.

5. An electrical connector according to claim 1, wherein an engagement projection extends from an outer surface of an upper end of said flexible lock arm, the engagement projection engaging with the lock portion.

6. An electrical connector according to claim 2, wherein an engagement projection extends from an outer surface of an upper end of said flexible lock arm, the engagement projection engaging with the lock portion.

7. An electrical connector according to claim 3, wherein an engagement projection extends from an outer surface of an upper end of said flexible lock arm, the engagement projection engaging with the lock portion.

8. An electrical connector according to claim 4, wherein an engagement projection extends from an outer surface of an upper end of said flexible lock arm, the engagement projection engaging with the lock portion.

9. An electrical connector according to claim 5, wherein an inclined surface is formed on an upper end of the engagement projection and an engagement wall is formed on a lower end of the engagement projection, the engagement wall engaging with an engagement wall of the locking portion.

10. An electrical connector according to claim 6, wherein an inclined surface is formed on an upper end of the engagement projection and an engagement wall is formed on a lower end of the engagement projection, the engagement wall engaging with an engagement wall of the locking portion.

11. An electrical connector according to claim 7, wherein an inclined surface is formed on an upper end of the engagement projection and an engagement wall is formed on a lower end of the engagement projection, the engagement wall engagement with an engagement wall of the locking portion.

12. An electrical connector according to claim 8, wherein an inclined surface is formed on an upper end of the engagement projection and an engagement wall is formed on a lower end of the engagement projection, the engagement wall engaging with an engagement wall of the locking portion.

* * * * *